US007015864B2

(12) United States Patent
Lin et al.

(10) Patent No.: US 7,015,864 B2
(45) Date of Patent: Mar. 21, 2006

(54) ELECTRONIC DEVICE AND 3-DIMENSIONAL ANTENNA STRUCTURE THEREOF

(75) Inventors: Huei Lin, Tao Yuan Shien (TW); Hsien-Chieh Chiu, Fongshan (TW)

(73) Assignee: Quanta Computer Inc., Tao Yuan Shien (TW)

( * ) Notice: Subject to any disclaimer, the term of this patent is extended or adjusted under 35 U.S.C. 154(b) by 0 days.

(21) Appl. No.: 10/864,985

(22) Filed: Jun. 10, 2004

(65) Prior Publication Data

US 2004/0263399 A1 Dec. 30, 2004

(30) Foreign Application Priority Data

Jun. 25, 2003 (TW) ..... 92211567 U

(51) Int. Cl.
*H01Q 1/24* (2006.01)

(52) U.S. Cl. ..... 343/702; 343/700 MS

(58) Field of Classification Search ..... 343/700 MS, 343/702

See application file for complete search history.

(56) References Cited

U.S. PATENT DOCUMENTS 4,791,423 A * 12/1988 Yokoyama et al. .. 343/700 MS
6,114,996 A * 9/2000 Nghiem ..... 343/700 MS
6,259,409 B1 7/2001 Fulton et al. ..... 343/702
6,348,893 B1 2/2002 Herranen et al. ..... 343/702
6,437,745 B1 8/2002 Vaisanen et al. ..... 343/702
6,539,207 B1 * 3/2003 del Castillo et al. ..... 455/90.3
6,545,643 B1 4/2003 Sward et al. ..... 343/702
6,593,888 B1 * 7/2003 Fu ..... 343/700 MS
6,675,461 B1 * 1/2004 Rowson et al. ..... 29/600
6,714,162 B1 * 3/2004 Kadambi et al. .... 343/700 MS
2003/0095072 A1 * 5/2003 Kwon et al. ..... 343/720

FOREIGN PATENT DOCUMENTS

TW 520583 9/1990

* cited by examiner

*Primary Examiner*—Tan Ho
(74) *Attorney, Agent, or Firm*—Thomas, Kayden, Horstemeyer & Risley

(57) ABSTRACT

An electronic device and 3-dimensional antenna structure thereof. The electronic device includes a printed board circuit module and a 3-dimensional antenna comprising a ground plane, and an antenna body having a first portion and a second portion disposed is such manner that one side of the second portion is connected to the first portion and another side of the second portion is connected to the ground plane. A feed line is connected to the first portion, a first regulation plate extends from one side of the first portion, a second regulation plate extends from another side of the first portion, near the printed circuit board and adjacent to the first regulation plate, and a third regulation plate extends upward from the ground plane perpendicular to the axis of the first portion.

10 Claims, 6 Drawing Sheets

ELECTRONIC DEVICE AND 3-DIMENSIONAL ANTENNA STRUCTURE THEREOF

BACKGROUND

The present invention relates to an electronic device, and in particular to an electronic device having a 3-dimensional antenna structure.

Traditionally, portable computing devices have been connected to network through a cable and a LAN card. However, as wireless capability becomes more popular, wireless LAN cards with PCMCIA (Personal Computer Memory Card International Association) interface or CF (compact flash) interface are growing in use. Based on the specifications of the PCMCIA and CF cards, only limited space therein is available to accommodate an antenna with appropriate volume and uniform radiation field intensity.

In various structures, the inverted-F antenna has advantages to recommend use with a compact LAN card.

The radiation mechanism of the inverted-F antenna possesses high flexibility in antenna design, and the radiation field and polarization can be more uniform.

When wireless PCMCIA or CF LAN cards are used, the radiation energy of the antenna in the limited space will decay or be reflected by other metal or plastic elements therein. Reflection distorts the radiation field pattern and decay reduces the overall efficiency of the antenna.

A CF card with inverted-F antenna is disclosed in U.S. Pat. Nos. 6,259,409, 6,348,893, 6,437,745 and 6,545,643, which disclose a planar inverted-F antenna on the antenna plane of a card. Moreover, Taiwan patent No. 520,583 discloses a planar inverted-F antenna formed on a printed circuit board and applied to a wireless LAN card for a notebook computer. However, the disclosed antenna structure requires insertion into the electronic device with the wireless LAN card in operation, such that the radiation energy of the antenna decays or is reflected by other elements of the electronic device, reducing efficiency. Additionally, the radiation field pattern and polarization of the planar inverted-F antenna cannot be regulated.

SUMMARY

Accordingly, an object of the invention is to provide a 3-dimentional inverted-F antenna structure improving on the conventional inverted-F antenna and enhancing the gain of antenna.

The invention provides a 3-dimentional inverted-F structure, comprising a ground plane and an antenna body having a first portion and a second portion. One side of the second portion is connected to the first portion and another side of the second portion is connected to the ground plane, a feed line connects to the antenna body, a field pattern regulation plate extends from one side of the first portion and a polarization regulation plate extends upward from the ground plane perpendicular to the first portion. The first portion, the second portion, and the feed line form an inverted F shape.

The field pattern regulation plate further comprises a first regulation plate extending from one side of the first portion and a second regulation plate extending from another side of the first portion. The second regulation plate is adjacent to the first regulation plate.

Furthermore, the invention also provides an electronic device having a 3-dimensional inverted-F antenna, e.g. a wireless CF LAN card.

The radiation field pattern and polarization provided by the invention can be effectively regulated to avoid decay or reflection from other elements of the electronic device, thereby improving gain.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION

Figure 1:
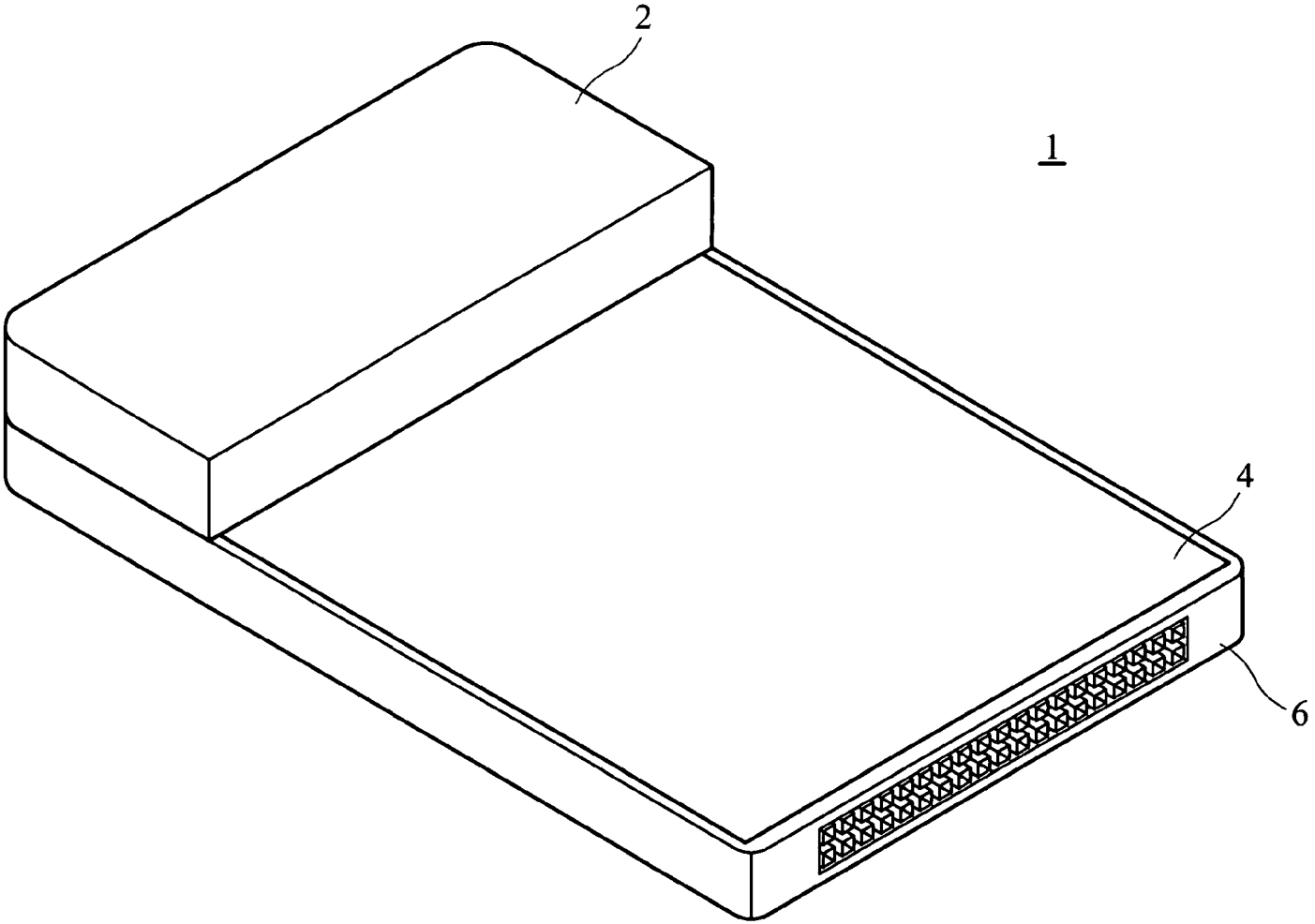
FIG. 1 is a perspective view of a wireless LAN card provided with a 3-dimensional antenna structure of the invention.
Figure 5:
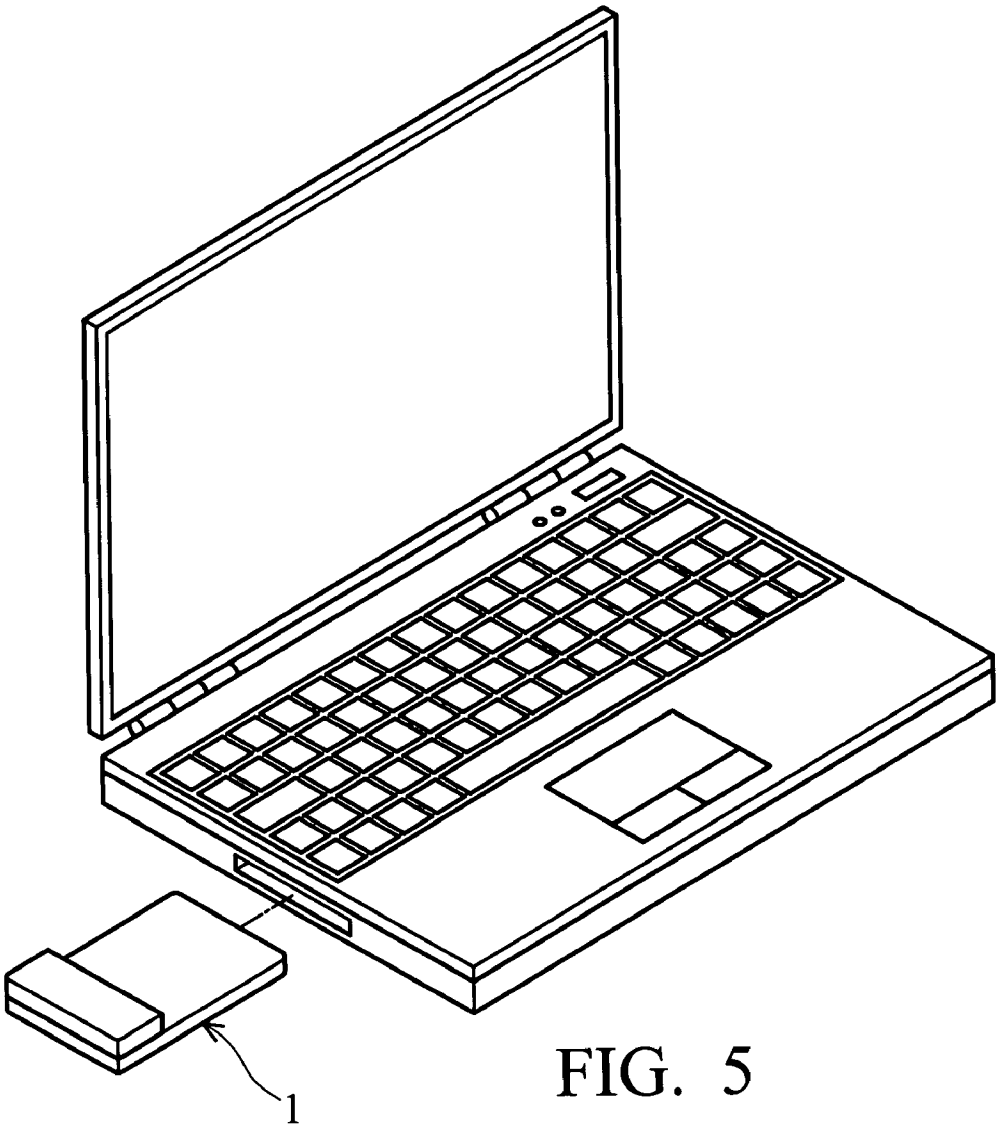
FIG. 5 is a perspective view of the wireless LAN card deployed in a notebook computer in the invention.

FIG. 1 is a perspective view of a wireless LAN card provided with a 3-dimensional antenna structure of the invention. While 3-dimensional antenna structure can be applied to various wireless communication devices, a wireless LAN card with CF interface is recited in this embodiment. As shown in FIG. 1, a wireless LAN card assembly 1 comprises an antenna guard 2, a metal shielding element 4 and a card body 6. The antenna guard 2 covers and protects the 3-dimensional antenna structure. The metal shielding element 4 covers a printed circuit board module 8 described as follows. As shown in FIG. 5, the wireless LAN card is inserted into a notebook computer, but the portion covered by the antenna guard 2 remains outside the notebook computer.

Figure 2:
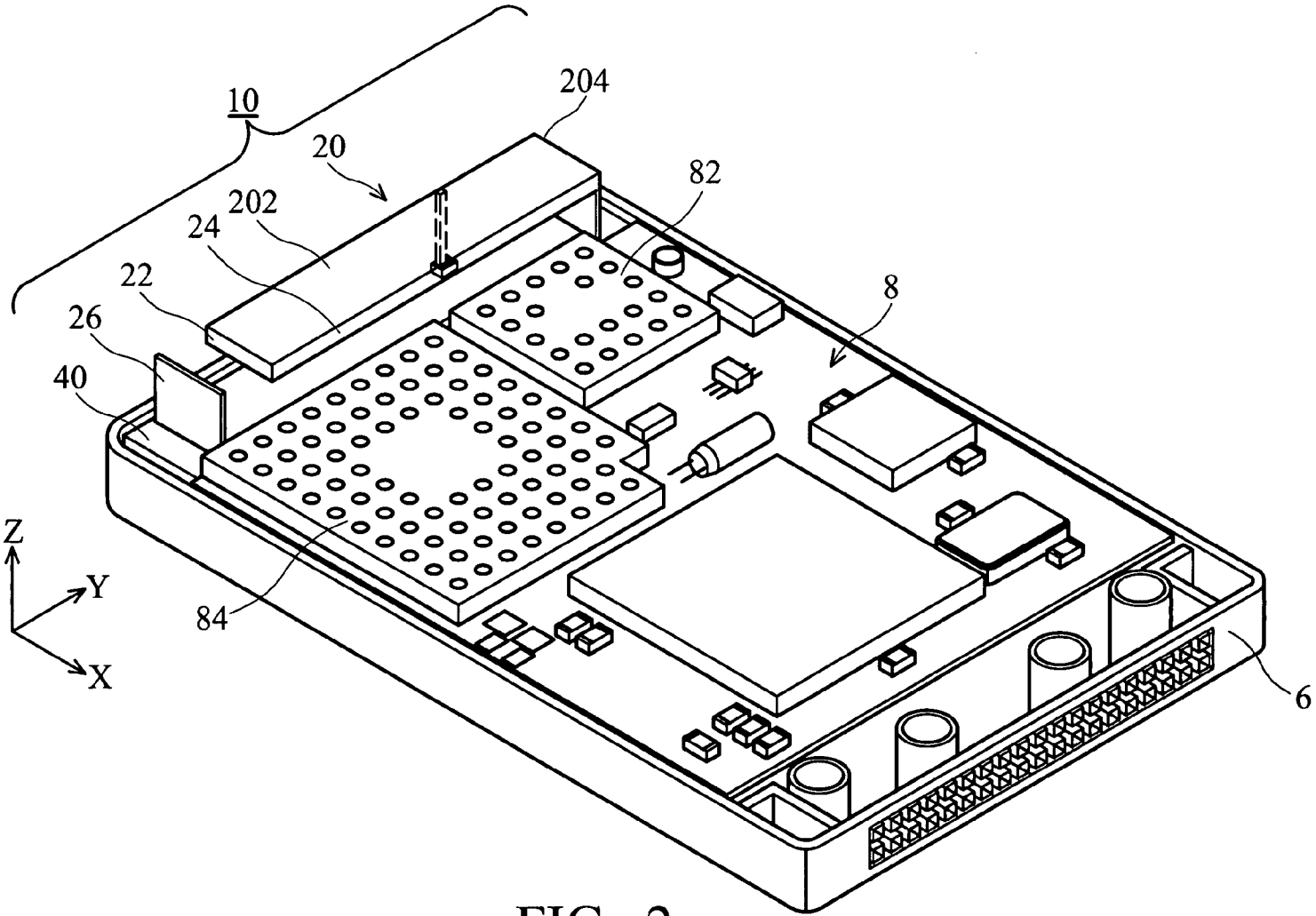
FIG. 2 is a perspective view of a wireless LAN card of the invention with metal shielding element and guard thereof removed.

FIG. 2 is a perspective view of a wireless LAN card of the invention, with metal shielding element and guard removed, with a reference coordinate X-Y-Z is defined to orient the antenna structure. The printed circuit board module 8 is accommodated in the card body 6, and metal shielding elements 82, 84 cover the high frequency circuit on the printed circuit board 8 to avoid leakage of electromagnetic radiation created by the high frequency circuit and interference of electromagnetic noise on the high frequency circuit. Thereby, EMI (electromagnetic interference) and leakage of electromagnetic radiation can be avoided.

As shown in FIG. 2, the 3-dimensional antenna of the invention comprises an antenna body 20, a ground plane 40, a feed line (shown with dotted lines), a first regulation plate 22, a second regulation plate 24 and a third regulation plate 26, wherein the antenna body 20 positioned on the ground plane 40 adjacent to the printed circuit board module 8 comprises a first portion 202 and a second portion 204. The second portion 204 is connected to the ground plane 40. The first portion 202 and the second portion 204 may be flat plates.

Figure 3:
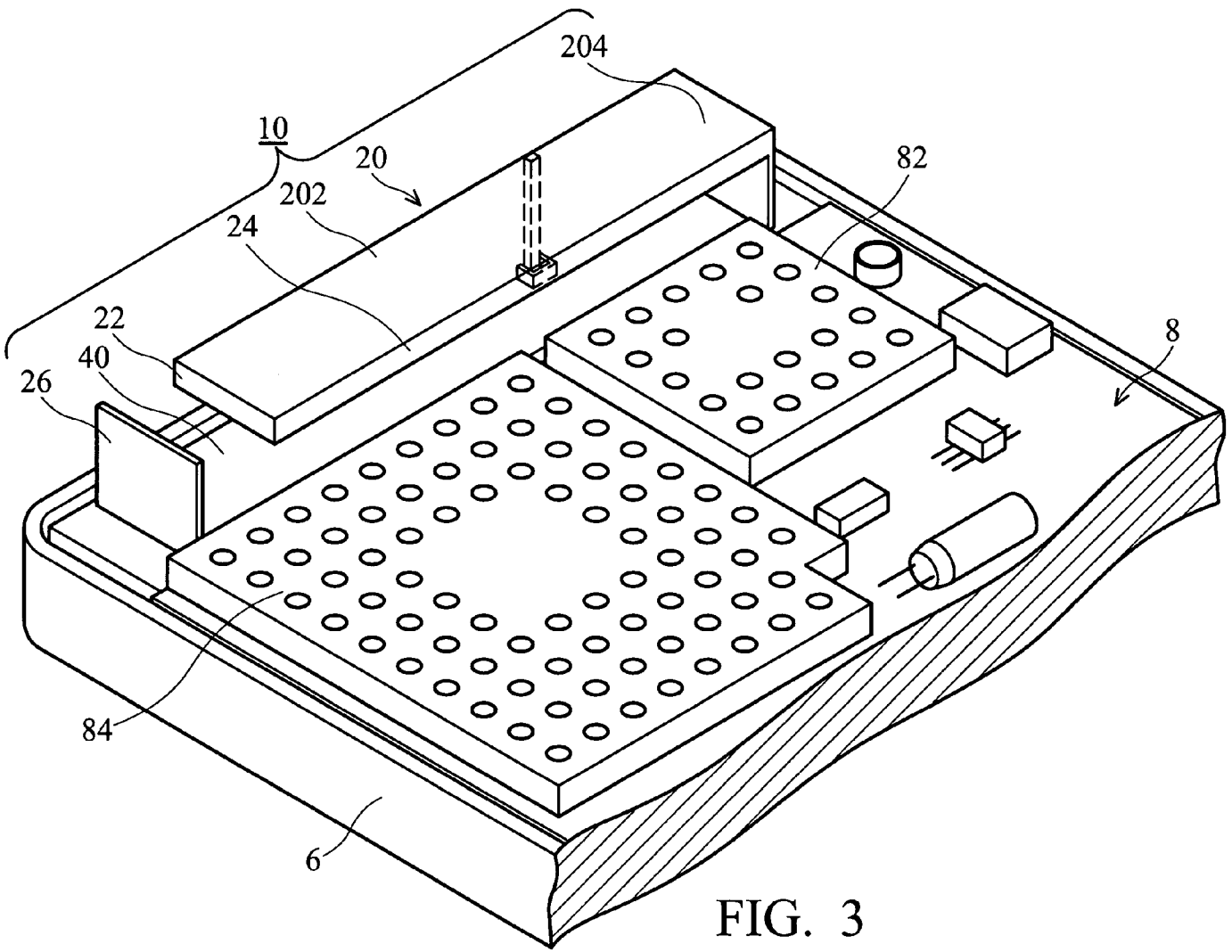
FIG. 3 is a locally enlarged view of FIG. 2.
Figure 4:
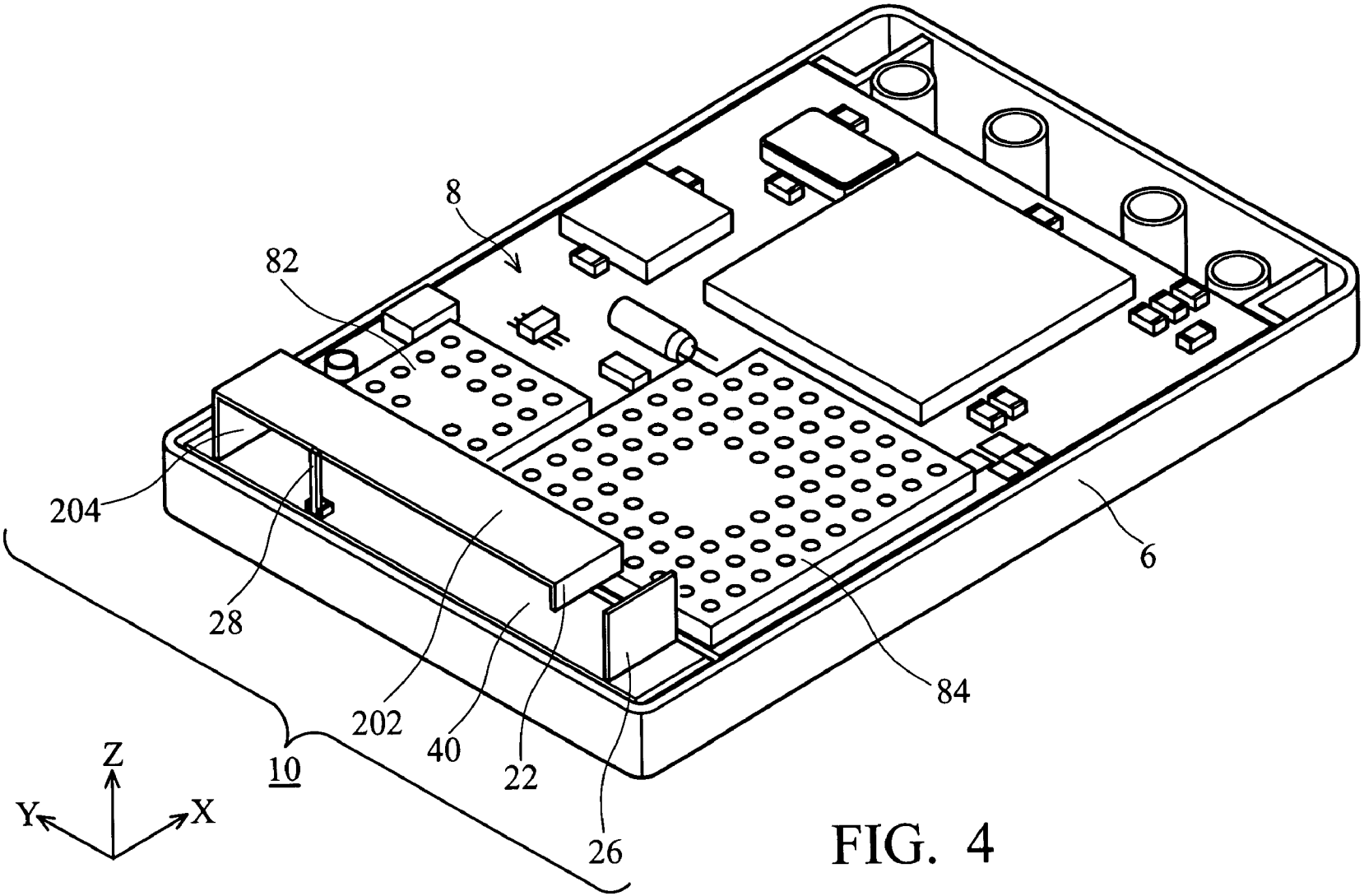
FIG. 4 is another perspective view of the wireless LAN card with a 3-dimensional antenna structure of the invention.

Referring to FIG. 3, the first regulation plate 22 extending from one side of the first portion 202 is adjacent to the second regulation plate 24 extending from another side of the first portion 202. The third regulation plate 26 extends upward from the ground plane 40 perpendicular to the axis of the first portion 202. Referring to FIG. 4, the feed line 28 is connected to the bottom of the first portion 202 without direct electrical connection to the ground plane 40.

As shown in FIG. 4, the 3-dimensional antenna structure 10 of the invention forms an inverted-F comprised of the first portion 202, the second portion 204 and the feed line 28. The radiation field pattern and polarization of the conventional planar inverted-F antenna cannot be regulated and gain thereof is reduced. Therefore, the 3-dimensional antenna structure used in the invention achieves optimal gain, and three regulation plates in the invention help regulate the radiation field pattern and polarization to enhance efficiency of the antenna.

Referring to FIG. 3, the first regulation plate 22 and the second regulation plate 24 extend from the edges of the first portion 202. The width (along X axis) and the length (along Y axis) of the first portion 202 determine the electromagnetic induction area and the near field induction effect thereof. Moreover, the length of the first portion 202 further determines the center frequency of the 3-dimensional antenna 10, and the width of the first portion 202 further determines characteristic impedance of the 3-dimensional antenna 10.

The configuration of the first regulation plate 22 and the second regulation plate 24 as well as the capacitance effect between the first portion 202 and the two regulation plates 22, 24 contribute to the regulation of surface current and current phase on the antenna body 20 so as to regulate the radiation field pattern and the center frequency of the 3-dimensional antenna 10. Therefore, the first regulation plate 22 and the second regulation plate 24 function as the field pattern regulation plates in the invention.

As shown in FIG. 3, the first regulation plate 22 has an X orientation, and the second regulation plate 24 a Y orientation. The first regulation plate 22 and the second regulation plate 24 face the printed circuit board module 8 and other electronic device such as a notebook computer. Thus, the radiation energy in the two orientations is more easily reflected or decayed. The first regulation plate 22 and the second regulation plate 24 can regulate the radiation field pattern influenced by other metal elements in the LAN card or of the notebook computer, and focus the radiation energy in useful directions.

Because the antenna body 20 has a better polarization in vertical orientation but poor polarization horizontally, a third regulation plate 26 is configured vertically on the ground plane 40 perpendicular to the first portion 202. As the antenna resonates, the third regulation plate 26 functions with the antenna body 20 to enhance polarization horizontally to normalize polarization as well as provide an omni-directional radiation pattern. Thus, the third regulation plate 26 functions as a polarization regulation plate 26.

The field pattern regulation plates 22, 24, polarization regulation plate 26 (i.e. the first regulation plate 22, the second regulation plate 24 and the third regulation plate 26) and other elements in the wireless LAN card are modeled and configured by computer software simulation to obtain best possible gain. The field pattern regulation plates 22, 24 can be integral with the antenna body 20. The elements of the 3-dimensional antenna 10, including the antenna body 20, the ground plane 40, the feed line 28, the first regulation plate 22, the second regulation plate 24 and the third regulation plate 26, can be metal or other conductive material. For example, the antenna body 20 can be made of oxygen-free copper to reduce electrical energy loss from superior electrical conductivity. In addition, a layer of palladium-nickel alloy is coated on the oxygen-free copper. The palladium-nickel alloy has similar electrical conductivity to the oxygen-free copper, and is easily soldered onto the printed circuit board so that the antenna 10 can be easily soldered onto the printed circuit board module 8.

The impedance of the antenna in the invention can be regulated to 50 ohm by adjusting the first portion 202, thereby eliminating an additional matching circuit. Thus, electrical efficiency can be promoted and manufacturing cost can be reduced.

Table 1 shows peak and average gains in different reference planes (XY, YZ and XZ plane) at different operating frequencies (2.40 GHz, 2.45 GHz and 2.50 GHz). Clearly, the gain in XY and YZ planes is better than in XZ plane, demonstrating that radiation from the antenna in the invention substantially covers the entire region.

Figure 6:
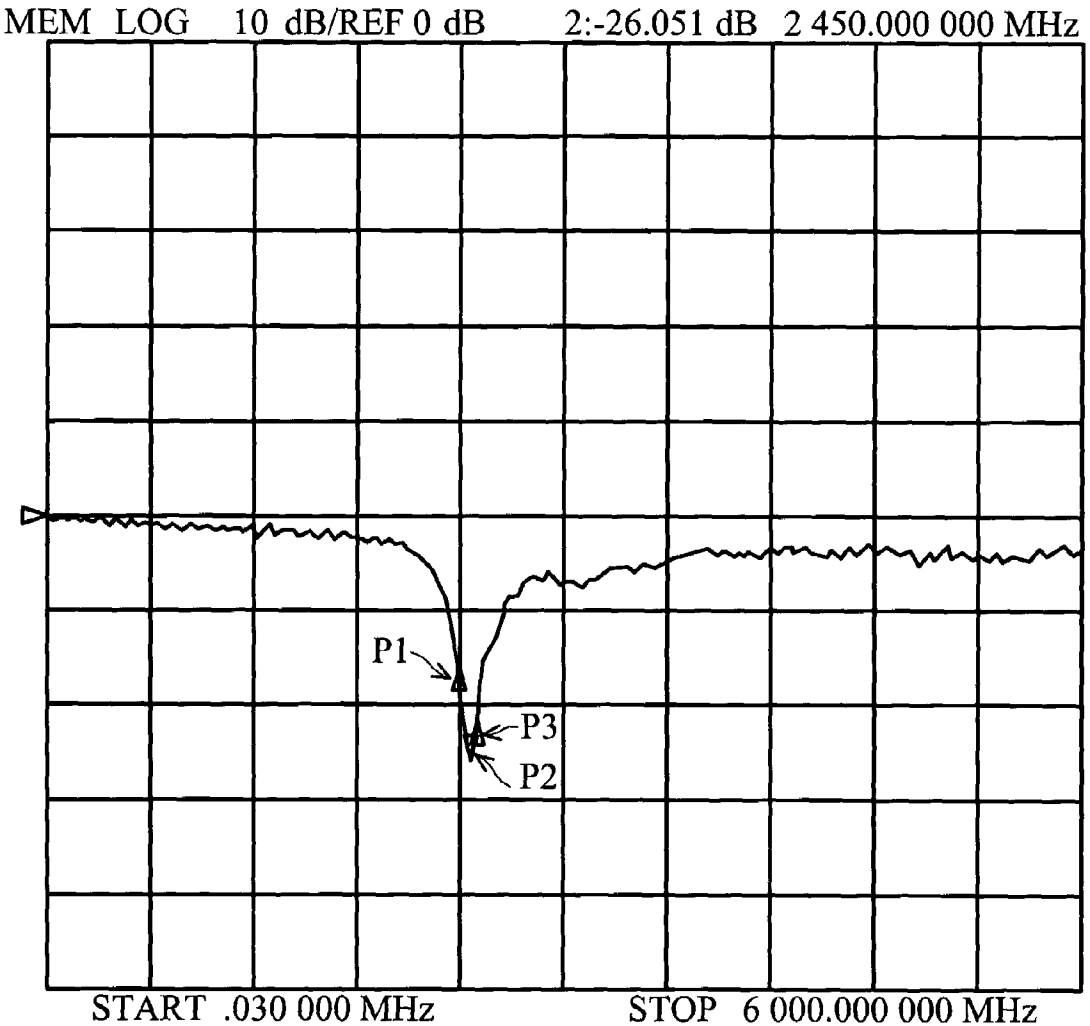
FIG. 6 shows a diagram of return loss performance of the 3-dimensional antenna structure of the invention.

FIG. 6 shows the return loss of the antenna, wherein P2 indicates at 2.45 GHz, reading of −26.051 dB, whereby return loss is 26.051 dB. P1 indicates −17.667 dB at 2.40 GHz, for return loss of 17.667 dB. P3 indicates −21.381 dB at 2.50 GHz, showing return loss of 21.381 dB. The electronic device having the antenna structure of the invention demonstrates, thusly, enhanced utility.

The antenna structure disclosed in the invention is based on a 3-dimensional inverted-F antenna structure accompanied by regulation plates to obtain omni-directional radiation field pattern and good radiation efficiency when deployed in electronic devices. Radiation field pattern and polarization are effectively regulated to avoid decay or reflection from other elements of the electronic device, thereby improving gain over conventional inverted-F antennas.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

Return Loss of 3-dimensional Inverted-F Antenna

TABLE 1

| Antenna Gain Measurement Report | Antenna Type Frequency (GHz) | Frame Inverse-F Antenna 2.40 | 2.45 | 2.50 |
|---|---|---|---|---|
| XY-Plane | Peak Gain | 1.06 | 1.26 | 1.18 |
| | Average Gain | −3.17 | −2.87 | −3.26 |
| YZ-Plane | Peak Gain | 0.41 | 0.89 | 0.77 |
| | Average Gain | −3.06 | −2.04 | −2.93 |
| XZ-Plane | Peak Gain | 0.54 | 0.86 | 0.73 |
| | Average Gain | −3.31 | −2.84 | −3.25 |

Antenna lie on the Y-Axis
Unit: dBi

What is claimed is:

1. A 3-dimensional antenna structure, comprising:

a ground plane;

an antenna body having a first portion end a second portion, wherein one side of the second portion is connected to the first portion and another side of the second portion is connected to the ground plane;

a feed line connected to the antenna body; and a field pattern regulation plate extending from one side of the first portion and comprising a first regulation plate extending from one side of the first portion and a second regulation plate extending from another side of the first portion, the second regulation plate adjacent to the first regulation plate.

2. The 3-dimensional antenna structure as claimed in claim 1, wherein the first regulation plate and the second regulation plate are integral with the antenna body.

3. The 3-dimensional antenna structure as claimed in claim 1, wherein the antenna body comprises oxygen-free copper.

4. The 3-dimensional antenna structure as claimed in claim 1, wherein the antenna body is coated with a layer of palladium-nickel alloy.

5. An electronic device, comprising:

a printed board circuit module;

a ground plane;

an antenna body having a first portion and a second portion, wherein one side of the second portion is connected to the first portion and another side of the second portion is connected to the ground plane;

a feed line connected to the first portion;

a first regulation plate extending from one side of the first portion;

a second regulation plate extending from another side of the first portion, near the printed circuit board and adjacent to the first regulation plate; and a third regulation plate extending upward from the ground plane perpendicular to the axis of the first portion.

6. The electronic device as claimed in claim 5, wherein the first portion, the second portion, and the feed line form an inverted F shape.

7. The electronic device as claimed in claim 5 further comprising a metal shielding element covering the printed circuit board and a guard covering the antenna body, the feed line, the first regulation plate, the second regulation plate and the third regulation plate.

8. The electronic device as claimed in claim 5, wherein the first regulation plate and the second regulation plate are integral with the antenna body.

9. The electronic device as claimed in claim 5, wherein the antenna body comprises oxygen-free copper.

10. The electronic device as claimed in claim 5, wherein the antenna body is coated with a layer of palladium-nickel alloy.

* * * * *